United States Patent [19]

Doner et al.

[11] Patent Number: 4,600,517

[45] Date of Patent: Jul. 15, 1986

[54] GREASE COMPOSITION CONTAINING BORONATED ALCOHOLS, AND HYDROXY-CONTAINING THICKENERS

[75] Inventors: John P. Doner, Sewell; Andrew G. Horodysky, Cherry Hill; John A. Keller, Jr., Pitman, all of N.J.

[73] Assignee: Mobil Oil Corporation, New York, N.Y.

[21] Appl. No.: 643,346

[22] Filed: Aug. 22, 1984

[51] Int. Cl.[4] ..... C10M 157/10

[52] U.S. Cl. ..... 252/32.7 E; 252/49.6; 252/52 R

[58] Field of Search ..... 252/49.6, 32.7 E, 52 R

[56] References Cited

U.S. PATENT DOCUMENTS 2,053,474 9/1936 Graves ..... 252/49.6
2,813,830 11/1957 Trautman ..... 252/49.6
4,440,656 4/1984 Horodysky ..... 252/49.6
4,472,289 9/1984 Horodysky et al. ..... 252/49.6

OTHER PUBLICATIONS

Boner, "Lubricating Greases" 1954 pp. 435–437, 497–498.

Smalheer, "Lubricant Additives," 1967,Chap. 1.

*Primary Examiner*—Jacqueline V. Howard

*Attorney, Agent, or Firm*—Alexander J. McKillop; Michael G. Gilman; Van D. Harrison, Jr.

[57] ABSTRACT

Grease compositions, wherein the grease is thickened with a metal hydroxy-containing soap grease thickener are provided. Another essential ingredient of the composition is a borated hydrocarbyl alcohol, and it may optionally contain phosphorus and sulfur moieties.

29 Claims, No Drawings

GREASE COMPOSITION CONTAINING BORONATED ALCOHOLS, AND HYDROXY-CONTAINING THICKENERS

BACKGROUND OF THE INVENTION

1. Field of the Invention

The invention is concerned with a novel group of compositions. It more particularly relates to a grease composition comprising oil, hydroxy-containing soap thickener and borated long chain alcohols, optionally containing phosphorus and sulfur moities.

2. Discussion of the Prior Art

With respect to the novel compositions of this invention, no prior art is known that teaches or suggests them. However, alcohols and mixtures of alcohols have been used as intermediates in the manufacture of a variety of lubricant additives, although the use of alcohols themselves has not been widespread lube oil additives because of potential oxidative and thermal instability and volatility difficulties. It has been found that the borated alcohols in combination with the particular grease thickener and the phosphorus and sulfur moieties provide dropping point characteristics in greases that the non-borated compositions do not provide. The grease compositions disclosed herein are, to the best of applicants' knowledge, novel, although some borated alcohols have been used in the past in commercial lubricant formulations to provide improvement in lubricity properties and have also, on occasion, been used in brake fluid formulations.

For example, U.S. Pat. No. 2,160,917 discloses lubricants containing low molecular weight borate esters, e.g., borate esters containing from 4 to 12 carbon atoms. The disclosed borates include the tributyl and trilauryl borates. Other patents include U.S. Pat. No. 3,014,870 (to mixtures of amine and certain boronic mono- or diesters); U.S. Pat. No. 3,108,966 (aryl boronic esters and thio acid ester lubricants); U.S. Pat. No. 3,133,951 (fuels containing dialkyl boron esters); U.S. Pat. No. 3,347,793 (tertiaryalkyl boron esters) and U.S. Pat. No. 3,509,054 (esters or boron acids with 2,6-dialkylphenols).

SUMMARY OF THE INVENTION

In accordance with the invention, there is provided an improved grease composition containing a major amount of a grease and a minor amount of a compound prepared by reacting a long chain alcohol of the formula $$ROH$$

wherein R is a $C_{10}$ to $C_{30}$ hydrocarbyl group, or mixtures thereof, with a boron compound which may be boric acid, boric oxide, metaborate or an alkyl borate of the formula $$(R^1O)_xB(OH)_y$$

wherein x is 1 to 3, y is 0 to 2, their sum being 3, and $R^1$ is an alkyl group containing from 1 to 6 carbon atoms, the improvement comprising thickening said grease with a thickener containing at least about 15% by weight of a hydroxy-containing soap thickener. The presence of phosphorus and sulfur moieties provides an even higher drop point.

Preferably the alcohol is overborated. By "overborated" is meant the presence in the borated product of more than a stoichiometric amount of boron.

The hydrocarbyl group includes straight and branched chain aliphatic groups, cycloaliphatic groups, aralkyl groups and alkaryl groups.

DESCRIPTION OF SPECIFIC EMBODIMENTS

R may be a linear or branched alkyl group or mixtures thereof. It may also be cycloaliphatic group, an alkaryl group, an alkaryl group or a linear or branched group having at least one unsaturated bond, i.e., an alkenyl group, or mixtures thereof. Among the linear alkyl groups, the mixed $C_{10}$ to $C_{20}$ groups are preferred, with the more preferred being mixed $C_{12}$ to $C_{15}$ groups. Among those containing unsaturation, one may mention the oleyl and linoleyl groups, with members containing 15 to 30 carbon atoms, mixtures thereof and mixtures with saturated members being preferred in this latter category.

Some of the alcohols that can be used for boration include dodecyl alcohol, tetradecyl alcohol, pentadecyl alcohol, hexadecyl alcohol, octadecyl alcohol, isooctadecyl alcohol, oleyl alcohol, mixed $C_{12}$ to $C_{15}$ alcohols and mixed $C_{20}$ to $C_{24}$ alcohols.

As noted hereinabove, the boron compound used is boric acid, boric oxide or an alkyl borate, preferably boric acid. The alkyl borates include the mono-, di- and trialkyl borates, such as the mono-, di- and trimethyl, triethyl, tripropyl, tributyl, triamyl and trihexyl borates.

The reaction to form the borate ester can be carried out at from about 100° C. to about 260° C., preferably from about 120° C. to about 200° C. The temperature chosen will depend for the most part on the particular reactants and on whether or not a solvent is used. In carrying out this reaction, it is preferable that quantities of reactants be chosen such that the molar ratio of alcohol to boron compound be from about 0.2 to about 2, preferably from about 0.5 to about 0.9. The alcohol can be reacted with an excess of the borating species to form a borate ester containing from about 0.1% by weight of boron to as much as 10% or more of boron.

While atmospheric pressure is generally preferred, the reaction can be advantageously run at from about 1 to about 5 atmospheres. Furthermore, where conditions warrant it, a solvent may be used. In general, any relatively non-polar, unreactive solvent can be used, including benzene, toluene, xylene and 1,4-dioxane. Other hydrocarbon and alcoholic solvents, which include propanol, butanol and the like, can be used. Mixtures of alcoholic and hydrocarbon solvents can be used also if desired.

The times for the reactions are not critical. Thus, any phase of the process can be carried out in from about 1 to about 20 hours.

A narrow class of thickening agents is preferred to make the grease of this invention. Included among the preferred thickening agents are those containing at least a portion of alkali metal or alkaline earth metal soaps or amine soaps of hydroxyl-containing fatty acids, fatty glycerides and fatty esters having from 12 to about 30 carbon atoms per molecule. The metals are typified by sodium, lithium, calcium and barium, with lithium being preferred. 12-hydroxystearic acid and glycerides and esters containing 12-hydroxystearates, 14-hydroxystearic acid, 16-hydroxystearic acid and 6-hydroxystearic acid are the preferred acids and fatty materials.

The entire amount of thickener need not be derived from the aforementioned preferred members. Significant benefit can be attained using as little as about 15% by weight of the 12-hydroxystearate-containing thickener in the total thickener. A complementary amount, i.e., up to about 85% by weight of a wide variety of thickening agents can be used in the grease of this invention. Included among the other useful thickening agents are alkali and alkaline earth metal soaps of methyl-12-hydroxystearate, diesters of a $C_4$ to $C_{12}$ dicarboxylic acid and tall oil fatty acids. Other alkali or alkaline earth metal fatty acids containing from 12 to 30 carbon atoms and no free hydroxyl may be used. These include soaps of stearic and oleic acids. The aforementioned thickening agents can be produced in open kettles, pressurized vessels, or continuous manufacturing units. All of these production methods are commonly used for greases and have the necessary supporting equipment to process the grease during and after the manufacture of the thickener.

Other thickening agents include salt and salt-soap complexes as calcium stearate-acetate (U.S. Pat. No. 2,197,263), barium stearate acetate (U.S. Pat. No. 2,564,561), calcium, stearate-caprylate-acetate complexes (U.S. Pat. No. 2,999,065), calcium caprylate-acetate (U.S. Pat. No. 2,999,066), and calcium salts and soaps of low-, intermediate- and high-molecular weight acids and of nut oil acids.

Another group of thickening agents comprises substituted ureas, phthalocyamines, indanthrene, pigments such as perylimides, pyromellitdiimides, and ammeline, as well as certain hydrophobic clays. These thickening agents can be prepared from clays which are initially hydrophilic in character, but which have been converted into a hydrophobic condition by the introduction of long-chain hydrocaron radicals into the surface of the clay particles prior to their use as a component of a grease composition, as, for example, by being subjected to a preliminary treatment with an organic cationic surface active agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, is believed to require no further discussion, and does not form a part of the present invention.

The third member(s) that may be present in the grease composition are the phosphorous and sulfur moieties. Both of these can be present in the same molecule, such as in a metal or non-metal phosphorodithioate of the formula $$\left[(R^2O)_2PZ\overset{Z}{\overset{\|}{}}\right]_n M$$

wherein $R^2$ is a hydrocarbyl group containing 3 to 18 carbon atoms, or mixtures thereof, M is a metal or non-metal, n is the valence of M and Z is oxygen or sulfur, at least one being sulfur.

In this compound, $R^2$ is preferably an alkyl group and may be a propyl, butyl, pentyl, hexyl, octyl, decyl, dodecyl, tetradecyl or octadecyl group, including those derived from isopropanol, butanol, isobutanol, sec-butanol, 4-methyl-2-pentanol, 2-ethylhexanol, oleyl alcohol, and mixtures thereof. Further included are alkaryl groups such as butylphenyl, octylphenyl, nonylphenyl and dodecylphenyl groups.

The metals covered by M include those in Groups IA, IB, IIA, IIB, VIB and VIII of the Periodic Table. Some that may be mentioned are lithium, sodium, calcium, zinc, cadmium, silver, molybdenum and gold. Non-metallic ions include organic groups derived from vinyl esters such as vinyl acetate, vinyl ethers such as butyl vinyl ether and epoxides such as propylene oxide and 1,2-epoxydodecane, as well as organic amines such as $C_{10}$ to $C_{20}$ hydrocarbyl amines including oleylamine and N-oleyl-1,3-propylenediamine, diamines, imidazolines and oxazolines.

The phosphorus and sulfur can also be supplied from the combination of two separate compounds, such as the combination of (1) a dihydrocarbyl phosphite having 2 to 10 carbon atoms in each hydrocarbyl group or mixtures of phosphites and (2) a sulfide such as sulfurized isobutylene, dibenzyl disulfide, sulfurized terpenes and sulfurized jojoba oil. The phosphites embrace the dibutyl, dihexyl, dioctyl, didecyl and similar phosphites. Phosphate esters containing 4 to 20 carbon atoms in each hydrocarbyl group, such as tributyl phosphate, tridecyl phosphate, tricresyl phosphate and mixtures of such phosphates, can also be used.

In summary, it is essential to the practice of this invention, in which greases having vastly improved dropping points are obtained, that at least the first two of the above-mentioned ingredients be formulated into the compositon. Thus:

first, with respect to the preparation of the grease, the total thickener will have at least about 15% by weight of a metal or non-metal hydroxy-containing soap therein, and there will be present from about 3% to about 20% by weight of total thickener based on the grease composition; and second, there will be added to the composition from about 0.01% to about 10% by weight thereof, preferably about 0.1% to about 2%, of a borated alcohol, in which the borated alcohol preferably has been reacted with at least an equimolar amount of a boron compound; and as a third component, the composition may have therein from 0.01% to about 10% by weight preferably, from 0.2% to 2% by weight of phosphorus- and sulfur-containing compounds or a mixture of two or more compounds which separately supply the phosphorus and sulfur moieties. If separate compounds are used, an amount of the mixture equivalent to the above concentration levels is used to supply desired amounts of phosphorus and sulfur.

It was noted that, when the hydroxy-containing thickener was used with the borated long chain alcohol, the dropping point of the grease was consistently unexpectedly higher than with a grease from the same grease vehicle and the same borated long chain alcohol, but with a different thickener, e.g., a non-hydroxy-containing thickener. Thus, the broad invention is to a grease composition comprising the two components mentioned.

In general, the reaction products of the present invention may be employed in any amount which is effective for imparting the desired degree of friction reduction, antiwear activity, antioxidant activity, high temperature stability or antirust activity. In many applications, however, the borated alcohol and the phosphorus- and/or sulfur-containing compound(s) are effectively employed in combined amounts from about 0.02% to about 20% by weight, and preferably from about 0.2% to about 4% of the total weight of the composition.

The greases of the present invention can be made from either a mineral oil or a synthetic oil, or mixtures thereof. In general, mineral oils, both paraffinic, naphthenic and mixtures thereof, may be of any suitable lubricating viscosity range, as for example, from about 45 SSU at 100° F. to about 6000 SSU at 100° F., and preferably from about 50 to about 250 SSU at 210° F. These oils may have viscosity indexes ranging to about 100 or higher. Viscosity indexes from about 70 to about 95 are preferred. The average molecular weights of these oils may range from about 250 to about 800. In making the grease, the lubricating oil from which it is prepared is generally employed in an amount sufficient to balance the total grease composition, after accounting for the desired quantity of the thickening agent, and other additive components to be included in the grease formulation.

In instances where synthetic oils are desired, in preference to mineral oils, various compounds of this type may be successfully utilized. Typical synthetic vehicles include polyisobutylene, polybutenes, hydrogenated polydecenes, polypropylene glycol, polyethylene glycol, trimethylol propane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether, phenoxy phenylethers.

The metallic soap grease compositions containing one or more of the borated alcohols, and, optionally, one or more of the sulfur and phosphorus combinations described herein provide advantages in increased dropping point, improved grease consistency properties, antirust characteristics and potential antifatigue, antiwear and antioxidant benefits unavailable in any of the prior greases known to us. The grease of this invention is unique in that it can be preferably manufactured by the admixture of additive quantities of the alcohol borates to the fully formed soap grease after completion of saponification.

The high temperature grease compositions described here are believed to be novel. To the best of our knowledge, the unique grease compositions using, inter alia, borated alcohols and the process of manufacturing such greases have not been previously reported or used.

The following examples will present illustrations of the invention. They are illustrative only, and are not meant to limit the invention.

EXAMPLE 1

Borated $C_{12}$ to $C_{15}$ Alcohols

Approximately 3032 g of mixed $C_{12}$–$C_{15}$ alkanols (obtained from Shell Chemical Co., and containing about 80% of linear alcohols comprising about 17.7% of $C_{12}$, about 30% of $C_{15}$, about 28% of $C_{14}$ and about 24% of $C_{15}$ alcohols, the mixture having an average molecular weight of about 208), 301 g of boric acid and about 250 g of butanol were charged to a reactor, and the contents were heated to about 155° C. over a period of about 10 hours until water evolution ceased. The solvents were vacuum topped and the product was filtered hot through diatomaceous earth.

EXAMPLE 2

A lithium hydroxystearate grease thickener was prepared by saponification of a mixture containing 12-hydroxystearic acid (8%) and the glyceride thereof (9%) with lithium hydroxide in a mineral oil vehicle (ISO 150 viscosity grade of a 70/30 mixture of naphthenic and paraffinic stocks) at about 350° F. in a closed contactor. After depressuring and dehydration of the thickener in an open kettle sufficient mineral oil was added to reduce the thickener content to about 9.0%. After cooling to 210° F., a typical grease additive package, consisting of an amine antioxidant, phenolic antioxidant, metallic dithiophosphate, sulfur-containing metal deactivator and nitrogen containing antirust additives, was added. The dropping point of this base grease was 201° C.

EXAMPLE 3

Two weight percent of borated alcohol mixture of Example 1 were added to the base grease of Example 2 at about 110° to about 115° C.

EXAMPLE 4

Base grease thickened with the lithium soap of a 50/50 (wt) mixture of stearic and palmitic acids.

EXAMPLE 5

50 wt. % of the base grease used in Example 2 plus 50 wt. % of the grease of Example 4.

EXAMPLE 6

Base grease of Example 4 containing 2% of the borated alcohol of Example 1.

The grease compositions of Example 2–6 were tested in the ASTM D2265 Dropping Point Test. The results are shown in Table 1.

TABLE 1

| Sample | D2265 Dropping Point °C. |
|---|---|
| Base grease of Example 2 (containing amine antioxidant, phenolic antioxidant, 1.5% zinc dithiophsophate and sulfur-containing metal deactivator and nitrogen containing antirust additives | 201 |
| Grease of Example 3 | 327 |
| Grease of Example 4 | 209 |
| Grease of Example 5 | 190 |
| Grease of Example 6 | 207 |

The above mentioned zinc dithiophosphate was derived from mixed $C_3$ secondary (isopropyl) and $C_6$ primary alcohols.

We claim:

1. An improved grease composition comprising a major amount of a grease and from about 0.01% to about 10% by weight of the composition of a reaction product made by reacting an alcohol of the formula

ROH wherein R is a hydrocarbyl group or mixture thereof, containing from 10 to 30 carbon atoms with a boron compound selected from the group consisting of boric acid, boric oxide, a metaborate and an alkyl borate of the formula $$(R^1—O)_xB(OH)_y$$

wherein x is 1 to 3, y is 0 to 2, their sum being 3, and $R^1$— is an alkyl group having 1 to 6 carbon atoms said grease being thickened with a thickener containing at least about 15% by weight of a hydroxy-containing thickener.

2. The composition of claim 1 additionally containing from about 0.01% to about 10% by weight of the composition of a phosphorus and sulfur compound or a mixture of phosphorus-containing and sulfur-containing compounds to supply a like amount of phosphorus and sulfur.

3. The composition of claim 1 wherein the thickener is an alkali metal, alkaline earth metal or amine soap of a hydroxy-containing fatty acid, fatty glyceride or fatty ester containing 12 to 30 carbon atoms.

4. The composition of claim 3 wherein the metal is sodium, lithium, calcium or barium.

5. The composition of claim 3 wherein the thickener is derived from 12-hydroxystearic acid, 14-hydroxystearic acid, 16-hydroxystearic acid, 6-hydroxystearic acid or the ester or glyceride thereof.

6. The composition of claim 1 wherein R is a straight or branched chain aliphatic group, a cycloaliphatic group, an alkaryl group or an aralkyl group.

7. The composition of claim 6 wherein R is a decyl, dodecyl, pentadecyl, hexadecyl, octadecyl, isooctadecyl, oleyl, mixed $C_{12}$ to $C_{15}$ alkyl, mixed $C_{15}$ to $C_{18}$ alkyl or $C_{20}$ to $C_{24}$ alkyl group.

8. The composition of claim 1 wherein the boron compound is boric acid.

9. The composition of claim 2 wherein the phosphorus and sulfur moieties are supplied by a phosphorothioate of the formula $$\left[(R^3O)_2P\overset{\overset{Z}{\|}}{Z}\right]_n M$$

wherein $R^3$ is a hydrocarbyl group containing 3 to 18 carbon atoms, M is a metal or non-metal, the non-metal selected from the group consisting of vinyl esters, vinyl ethers, epoxides, and organic amines, n is the valence of M, and Z is oxygen or sulfur, at least one z atom being sulfur.

10. The composition of claim 9 wherein $R^3$ is an alkyl group or an alkaryl group.

11. The composition of claim 10 wherein $R^3$ is a propyl, butyl, pentyl, hexyl, octyl, dodecyl, tetradecyl, octadecyl, butylphenyl, octylphenyl, nonylphenyl, dodecylphenyl or oleyl group or mixtures thereof.

12. The composition of claim 11 wherein $R^3$ is derived from isopropanol, butanol, isobutanol, sec-butanol, 4-methyl-2-pentanol, 2-ethylhexanol or mixtures thereof.

13. The composition of claim 9 wherein M is a metal from Group IA, IB, IIA, IIB, VIB or VIII of the Periodic Table.

14. The composition of claim 13 wherein the metal is lithium, sodium, calcium, barium, zinc, cadmium, molybdenum or gold.

15. The composition of claim 14 wherein the metal is zinc.

16. The composition of claim 14 wherein the metal is molybdenum.

17. The composition of claim 9 wherein M is derived from vinyl acetate, butyl vinyl ether, propylene oxide, 1,2-epoxydodecane, or $C_{10}$ to $C_{20}$ aliphatic amines.

18. The composition of claim 2 wherein the phosphorus and sulfur moieties are supplied by a combination of (1) a dihydrocarbyl phosphite having 2 to 10 carbon atoms in each hydrocarbyl group, mixtures of such phosphites, or a dihydrocarbyl phosphate ester having 4 to 20 carbon atoms in each hydrocarbyl group and (2) a sulfide selected from the group consisting of sulfurized isobutylene, dibenzyl disulfide, sulfurized terpenes and sulfurized jojoba oil.

19. The composition of claim 18 wherein the phosphite is a dibutyl, dihexyl, dioctyl or didecyl phosphite or mixtures thereof.

20. The composition of claim 18 wherein the phosphate ester is a tributyl, tridecyl or tricresyl phosphate or mixtures thereof.

21. The composition of claim 18 wherein the alcohol is a mixed $C_{12}$ to $C_{15}$ alkanol, the boron compound is boric acid and the phosphorus- and sulfur-containing compound is zinc dialkyl phosphorodithioate wherein the alkyl group is derived from mixed $C_3$ secondary and $C_6$ primary alcohols.

22. The composition of claim 1 wherein the grease vehicle is a mineral oil.

23. The composition of claim 1 wherein the grease vehicle is a synthetic oil.

24. The composition of claim 1 wherein the grease vehicle is a mixture of mineral and synthetic oils.

25. An improved process for manufacturing a grease containing additive, comprising the steps of thickening the grease with a thickener containing at least about 15% by weight of a hydroxy-containing soap thickener and then adding to said grease at from about 50° C. to about 200° C., a reaction product made by reacting an alcohol of the formula

ROH

PS wherein R is a hydrocarbyl group or mixture thereof, containing from 10 to 30 carbon atoms with a boron compound selected from the group consisting of boric acid, boric oxide, a metaborate and an alkyl borate of the formula $$(R^1\text{—}O)_xB(OH)_y$$

wherein x is 1 to 3, y is 0 to 2, their sum being 3, and $R^1$ is an alkyl group having 1 to 6 carbon atoms.

26. The process of claim 25 wherein phosphorus and sulfur moieties are additionally added.

27. The process of claim 26 wherein the thickener is 12-hydroxystearic acid, the boron compound is boric acid and the phosphorus and sulfur are supplied by a dihydrocarbyl phosphorodithioate.

28. A method of improving the dropping point of a grease composition comprising a major proportion of a grease and from about 0.01% to about 10% by weight of the composition of a reaction product made by reacting an alcohol of the formula

ROH where R is a hydrocarbyl group, or mixture thereof, containing from 10 to 30 carbon atoms with a boron compound selected from the group consisting of boric acid, boric oxide, a metaborate and an alkyl borate of the formula $(R^1—O)_xB(OH)_y$ wherein x is 1 to 3, y is 0 to 2, their sum being 3, and $R^1$ is an alkyl group having 1 to 6 carbon atoms comprising thickening said grease with a thickener containing at least about 15% by weight of a hydroxy-containing thickener.

29. The method of claim 28 in which the grease composition additionally contains from about 0.01% to about 10% by weight of the composition of a phosphorus and sulfur compound or a mixture of phosphorus-containing and sulfur-containing compounds to supply a like amount of phosphorus and sulfur.

* * * * *

UNITED STATES PATENT AND TRADEMARK OFFICE

CERTIFICATE OF CORRECTION

PATENT NO. : 4,600,517

DATED : July 15, 1986

INVENTOR(S) : John P. DONER et al

It is certified that error appears in the above-identified patent and that said Letters Patent is hereby corrected as shown below:

Column 8, line 40, delete "PS" at the beginning of the line.

Column 8, line 64, change "where" to --wherein--.

Signed and Sealed this

Third Day of March, 1987

*Attest:*

DONALD J. QUIGG

*Attesting Officer*

*Commissioner of Patents and Trademarks*